United States Patent [19]

Wilson et al.

[11] Patent Number: 4,755,010

[45] Date of Patent: Jul. 5, 1988

[54] COMPUTER WORK STATION AND PRINTER CABINET

[75] Inventors: Harold R. Wilson; Paul S. Gartland, both of Holland, Mich.

[73] Assignee: Haworth, Inc., Holland, Mich.

[21] Appl. No.: 35,193

[22] Filed: Apr. 6, 1987

Related U.S. Application Data

[63] Continuation of Ser. No. 896,674, Aug. 14, 1986, abandoned.

[51] Int. Cl.[4] ..... A47B 21/00

[52] U.S. Cl. ..... 312/208; 248/1 B; 400/691; 211/45; 312/40

[58] Field of Search ..... 298/1 B, 1 A, 676, 678; 108/59, 60; 211/45, 50; 312/20, 39, 40, 196; 400/691

[56] References Cited

U.S. PATENT DOCUMENTS

| | | | |
|---|---|---|---|
| 1,656,153 | 1/1928 | Smith | 312/40 |
| 1,761,056 | 6/1930 | Smith | 400/691 |
| 2,219,762 | 10/1940 | Burdick | 312/208 |
| 3,178,172 | 4/1965 | Lettan | 211/50 |
| 3,771,847 | 11/1973 | Aylworth | 312/245 |
| 3,899,228 | 8/1975 | Schreiber | 312/245 |
| 3,939,956 | 2/1976 | Stamou | 400/691 |
| 4,283,099 | 8/1981 | Burton . | |
| 4,522,521 | 6/1985 | Scott | 400/491 |
| 4,544,065 | 1/1985 | Mueller | 211/50 |
| 4,563,102 | 7/1986 | Sanders et al. | 312/208 |
| 4,568,212 | 2/1986 | Cooke et al. | 400/491 |
| 4,626,048 | 2/1986 | Goodlander | 400/691 |
| 4,640,199 | 2/1987 | Zigman | 312/208 |

OTHER PUBLICATIONS

"The Office", Feb. 1981, Tab Products Co., Tab Series 300 Fidelity Products, Co. 1981, p. 40 of brochure.

Wright Line, A Unit of Barry Write, 1981., Printer Terminal Stand IBM Technical Disclosure Bulletin, vol. 23, No. 4, Sep., 1980, System Packaging for Small Computer by F. Wilkey, Jr., pp. 1589–1590.

Global Computer Supplies, Jan. 1987, CAT-71SA.

*Primary Examiner*—Kenneth J. Dorner

*Assistant Examiner*—Gerald Anderson

*Attorney, Agent, or Firm*—Flynn, Thiel, Boutell & Tanis

[57] ABSTRACT

A work station having a cabinet structure mountable on a wall and positionable above a work surface, the cabinet structure being adapted to store and facilitate utilization of a computer printer. The cabinet has a front door which hinges upwardly to provide access to the interior of the cabinet, the latter having two interior shelves. The upper shelf mounts thereon a printer, and the next lowermost shelf supports thereon a paper web which is fed upwardly through a slot in the rear edge of the upper shelf for supply to the printer. The web of paper discharged from the printer passes rearwardly and then downwardly through slots in the shelves for collection below the paper supply shelf. A third shelf is preferably provided below the paper supply shelf for collecting the paper thereon discharged from the printer.

13 Claims, 3 Drawing Sheets

COMPUTER WORK STATION AND PRINTER CABINET

This application is a continuation of U.S. Ser. No. 896,674, filed Aug. 14, 1986, now abandoned.

FIELD OF THE INVENTION

This invention relates to an improved work station for a computer which includes a printer and, more specifically, to an improved cabinet structure for enclosing the printer.

BACKGROUND OF THE INVENTION

Small individual computers are now extensively utilized in offices and the like, and many of these computers are connected to printers which normally operate at rather high speed and hence are rather noisy. Further, many of these printers are of the tractor-feed type in that they utilize a continuous web of paper sheets joined together through score lines so that the web is supplied in a stack whereby the joined sheets alternately fold back and forth on top of one another so as to permit the web of paper to be continuously fed through the printer. While this type of paper is widely used on computer printers, nevertheless the storing of the paper both as supplied to and discharged from the printer is oftentimes a problem in view of the inadequate storage space or shelving available for both the supply and discharged paper.

The above problems are even more acute in environments of the open office type, that is, office environments employing space-divider walls for dividing large open areas into smaller work areas. At the present time, the equipment which mounts on or is directly associated with the open office systems has not satisfactorily handled the problems associated with computer printers, specifically the problems of noise and paper handling.

Accordingly, the present invention relates to an improved work station associated with an open office system, which work station is designed for use with a computer including a printer, and is believed to significantly improve upon many of the prior disadvantages.

It is also an object of this invention to provide, as part of the improved work station, an improved cabinet structure for enclosing the printer and for facilitating the handling of paper as both supplied to and discharged from the printer.

In the computer work station of this invention, the work station includes a conventional upright wall panel which permits a horizontal work surface to be mounted thereon in a cantilevered fashion so as to permit the computer to be supported thereon. A printer cabinet is also mounted on the wall panel in cantilevered fashion so as to project therefrom in upwardly spaced relationship above the work surface. The printer cabinet includes a plurality of shelves disposed below a top wall, and has an openable door which moves into a storage position above the top wall to provide free access to the interior of the cabinet, with the door closing off the front of the cabinet when in a closed position. The upper shelf permits the printer to be mounted thereon, an intermediate shelf permits the stack of supply paper to be supported thereon, and a lower shelf permits collection thereon of the paper discharged from the printer.

In the improved printer cabinet of this invention, as briefly described above, at least the upper shelf is preferably horizontally slidably supported so that it can be moved outwardly from the cabinet. Each of the upper and middle shelves has a recess or slot adjacent the rear edge thereof to permit the paper to be vertically fed therethrough. The door, when in the closed position, preferably hangs downwardly so as to enclose the compartments disposed above both the upper and middle shelves so as to hide the printer and the supply paper, whereas the lower shelf is continuously open so as to permit ready inspection of the paper as discharged from the printer.

Other objects and purposes of the apparatus according to the present invention will be apparent to persons familiar with structures of this general type upon reading the following specification and inspecting the accompanying drawings.

Figure 1:
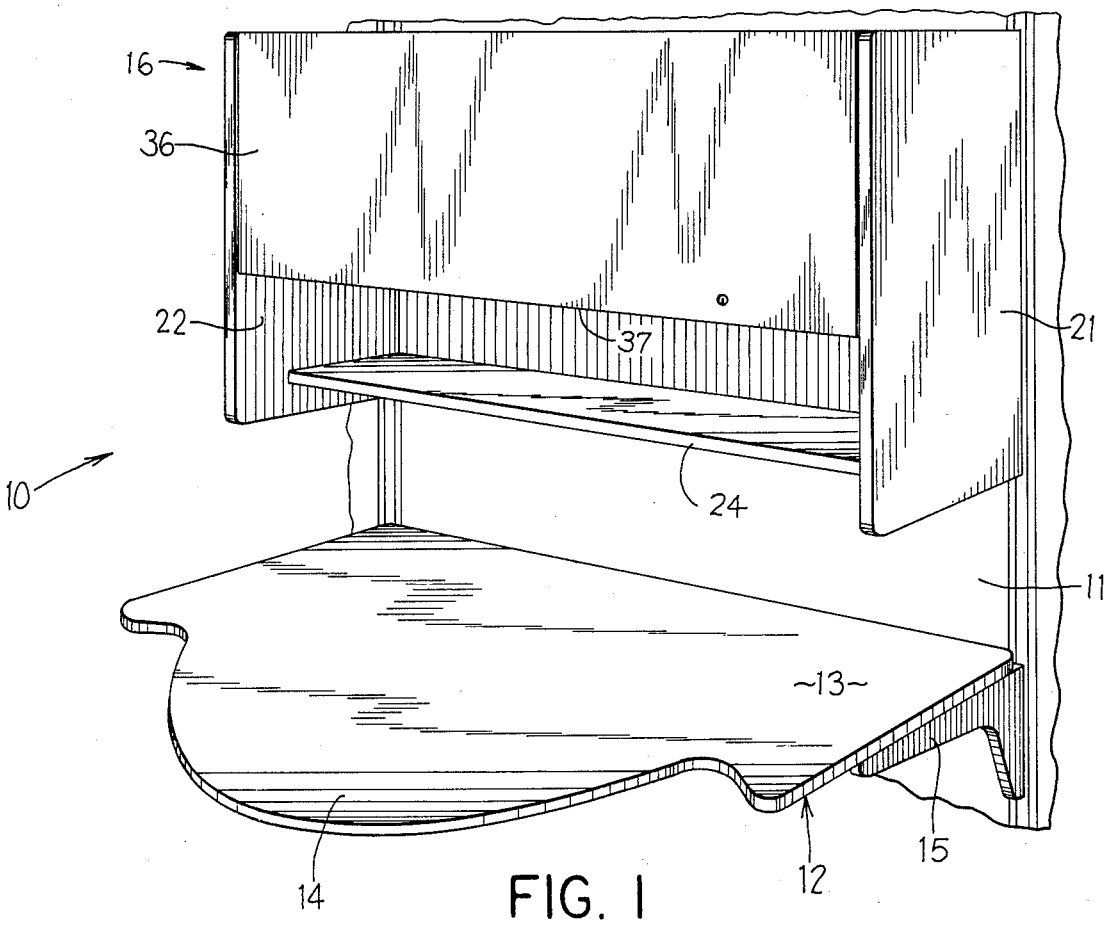
FIG. 1 is a perspective view which illustrates the overall work station for a computer.
Figure 6:
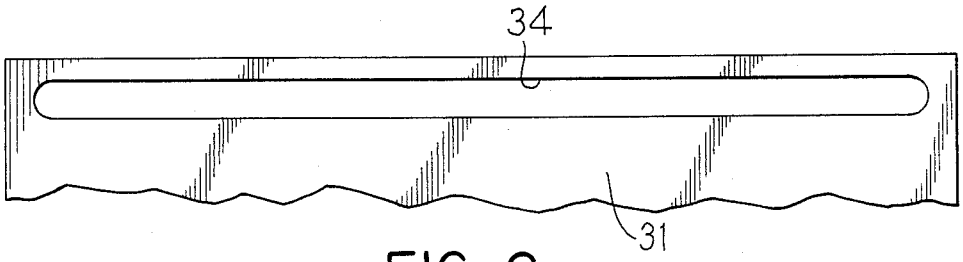
FIG. 6 is a fragmentary view taken along line VI—VI in FIG. 4.

Certain terminology will be used in the following description for convenience in reference only, and will not be limiting. For example, the words "upwardly", "downwardly", "rightwardly" and "leftwardly" will refer to directions in the drawings to which reference is made. The word "upwardly" will also refer to movement of the printer cabinet door in an opening direction, and "downwardly" will refer to movement of the door in a closing direction. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

FIG. 1 illustrates therein a work station 10 according to the present invention and designed specifically for accommodating a computer, including a printer. This work station includes an upright space-dividing wall panel 11 which projects vertically upwardly through a distance which is less than standard floor-to-ceiling height. This wall panel 11 is of standard and well-known construction, and the opposite vertical ends thereof are typically horizontally serially joined to other similar wall panels so as to define a system.

The panel 11 mounts a table or desklike work surface 12 which defines thereon an upper horizontally enlarged surface 13 adapted to function as a working surface, and adapted more specifically to support a computer (not shown) thereon. This work surface 12 is mounted on the panel 11 by a pair of brackets 15 which secure to the underside of the work surface adjacent the end edges thereof, and the brackets have hooks which engage within slotted uprights or posts associated with the opposite end edges of the panel 11. This manner of mounting the work surface in a cantilevered fashion on the wall panel is well known, and one example thereof is illustrated by U.S. Pat. No. 4,198,913, as owned by the assignee of this application.

While standard work surfaces generally have a straight front edge, nevertheless the work surface 12 associated with the work station of this invention preferably is provided with a rounded enlargement 14 projecting outwardly beyond the front edge, this enlargement 14 being disposed substantially midway between the ends of the work surface. This enlargement 14 provides a larger upper surface 13, and in particular is desirable when a computer is positioned on the work surface since it provides increased access to the computer.

The work station 10 also includes therein the improved cabinet structure 16 of the present invention, which cabinet is particularly suitable for housing therein a printer, and is also designed for facilitating the handling of paper which is both supplied to and discharged from the printer.

The cabinet structure 16, as illustrated by FIGS. 2–5, includes a rigid frame 19 which is of a rectangular sleevelike arrangement formed by generally parallel sidewalls 21 and 22 rigidly joined together by parallel top and bottom walls 23 and 24, respectively. The bottom wall 24 functions as a bottom shelf, as explained hereinafter.

To removably secure the frame 19 of the cabinet structure to the wall 11 in a cantilevered fashion, the sidewalls 21, 22 have rearwardly projecting hook structures 26 associated therewith, the latter being releasably engageable with the slotted uprights of the panel 11 to permit the cabinet structure to be fixedly but releasably attached to the panel so as to be hung thereon adjacent one side thereof. One mounting bracket structure for securing a cabinet of this general type to the wall panel is also illustrated by U.S. Pat. No. 4,222,542, as owned by the assignee of this application.

The rear of the cabinet structure 16 is normally open, but the rear is obviously closed by the panel 11 when the cabinet structure is mounted thereon.

In addition to the bottom shelf defined by the bottom wall 24, the cabinet also includes two other shelves, namely a top shelf 31 and an intermediate shelf 32, which shelves extend generally parallel to and are spaced vertically upwardly above the bottom shelf 24. Each of these interior shelves 31, 32 extend generally the full length and width of the cabinet, and each is horizontally slidably supported relative to the cabinet frame 19. For example, each of the shelves 31, 32 has the end edges thereof attached to a telescopic slide arrangement 33, which arrangement in turn mounts to the adjacent sidewall 21 or 22. This telescopic slide arrangement 33 is of conventional and well-known construction. These slide arrangements 33 enable each of the shelves 31, 32 to be horizontally slidably moved between a normally closed position wherein the shelf is disposed entirely within the cabinet frame as illustrated by solid lines in FIG. 4, and an open position wherein the shelf can be individually slidably horizontally moved forwardly so as to project outwardly from the cabinet frame and hence be spaced a substantial distance forwardly from the wall panel 11. This open position is illustrated by the dotted line position of the upper shelf 31 in FIG. 4.

Each of shelves 31, 32 has a recess or slot 34 formed therein and projecting therethrough in the vicinity of the rear edge thereof. This slot 34 is elongated in the lengthwise direction of the respective shelf. Each slot 34 is disposed closely adjacent the rear edge of the respective shelf but extends substantially the full length of the shelf. The slots 34 in the illustrated embodiment extend vertically through the shelf but are spaced inwardly a slight distance from the rear edge of the shelf so as to thus define a closed opening or slot which extends vertically but does not open sidewardly (i.e. horizontally). However, it will be appreciated that these closed slots could be replaced with cutaway recesses which open inwardly from the rear edge of the shelf, although such is not preferred since such open recesses do not provide for positive confinement and control over the paper which is supplied to and from the printer, as explained hereinafter.

The cabinet structure 16 also includes an openable door 36 which is associated with the front side of the frame. This door 36, when in a closed position, extends completely across the width of the frame 19 and projects downwardly from the top wall 23 so that the lower free edge 37 of the door is disposed closely adjacent or slightly below the intermediate shelf 32. With the door in the closed position, there is defined two closed storage compartments within the cabinet, namely an upper compartment 38 disposed above the upper shelf 31, and an intermediate compartment 39 disposed above the middle shelf 32. The cabinet also defines a lower compartment 41 which is defined directly above the bottom shelf 24, but since the door does not project downwardly beyond the middle shelf 32, this lower compartment 41 is accessible at all times through the front side of the frame.

Figure 3:
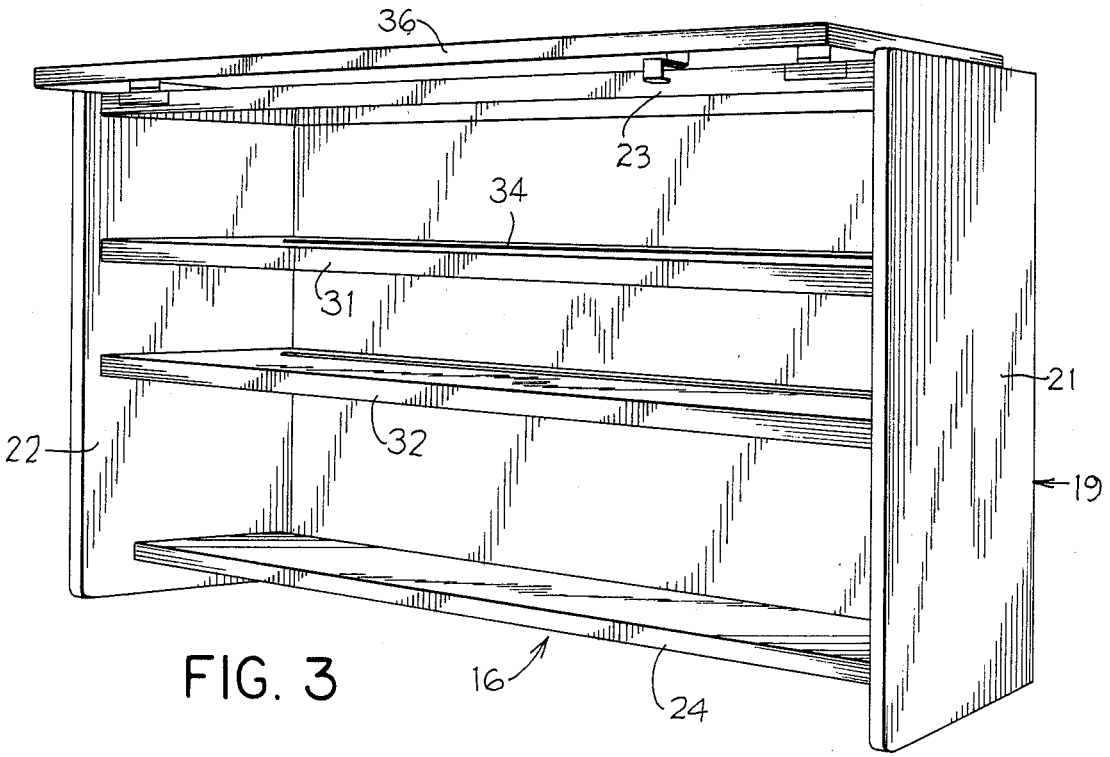
FIG. 3 is a view similar to FIG. 2 but illustrating the door of the printer cabinet in an open position.
Figure 2:
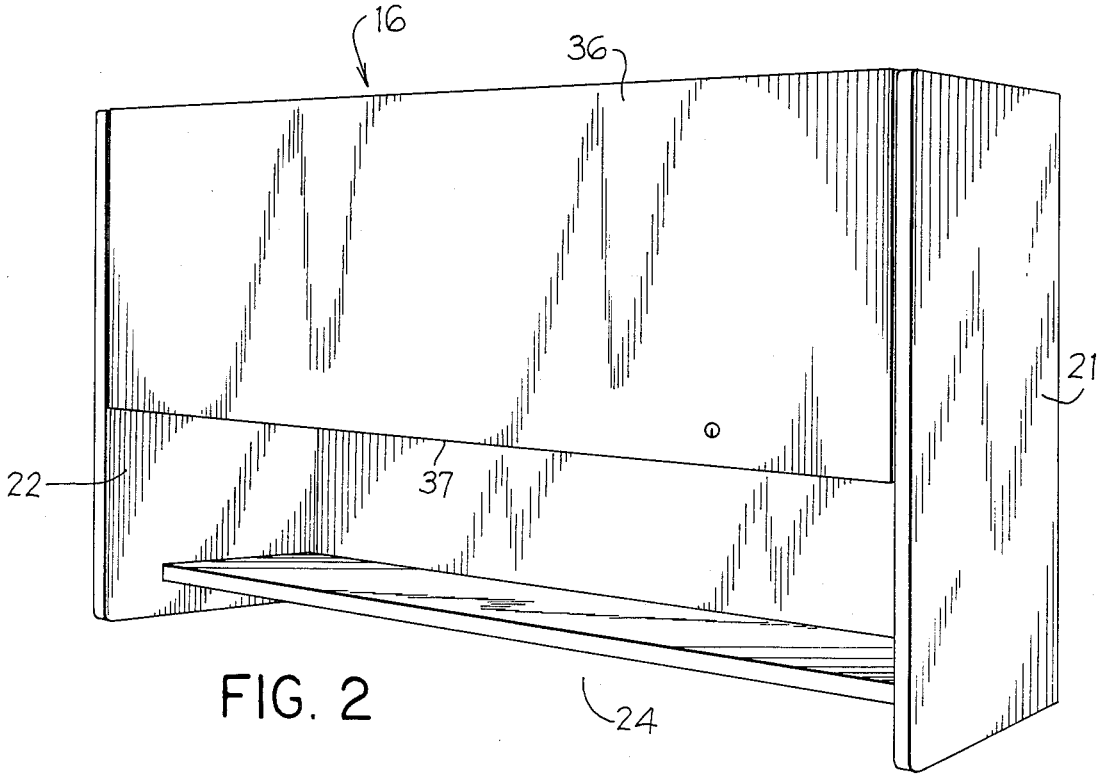
FIG. 2 is a perspective view which illustrates solely the printer cabinet which is associated with the work station.
Figure 5:
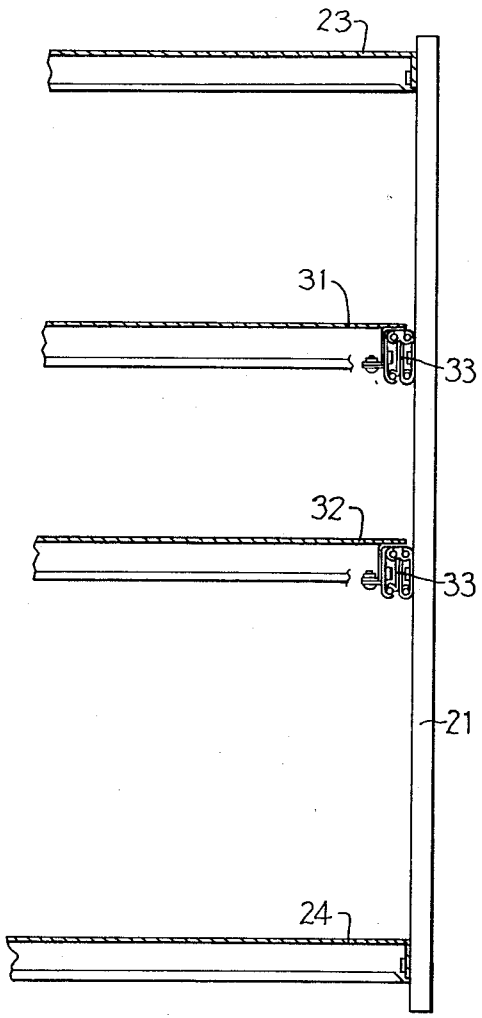
FIG. 5 is a fragmentary sectional view along line V—V in FIG. 4.
Figure 4:
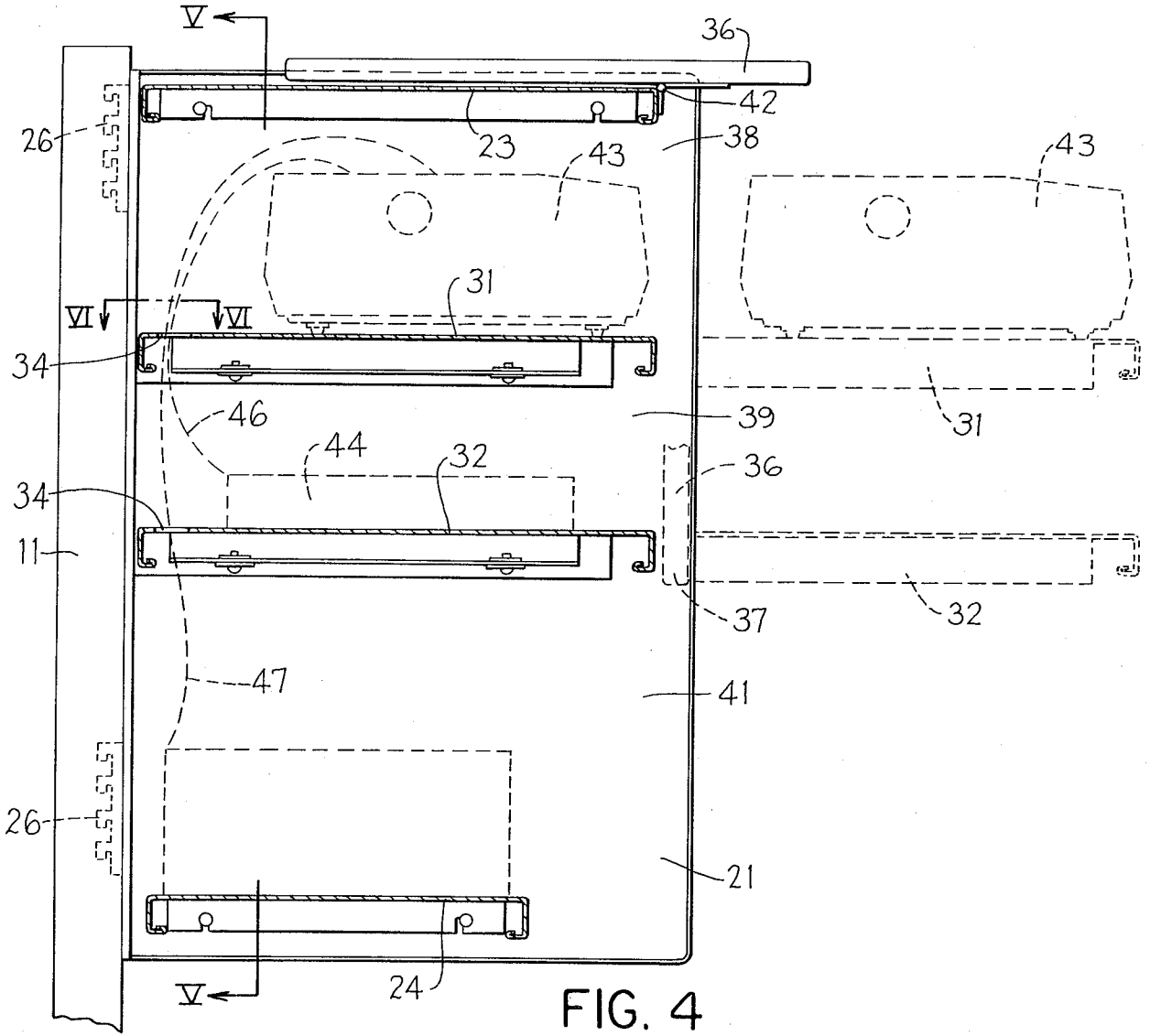
FIG. 4 is a sectional elevational view as taken substantially centrally through the printer cabinet when in an open position.

The door 36 is adapted to be readily manually moved into an open position wherein the door will self-store directly above the top wall 23, as illustrated by FIGS. 3 and 4. To permit the door to be moved between the open and closed positions which are respectively illustrated by FIGS. 3 and 2,the door 36 is attached to the top wall 23 by a pair of hinged and telescopic ball slide units 42, these units and their attachment to the cabinet frame and door being conventional and illustrated by U.S. Pat. No. 3,771,847.

OPERATION

The use and operation of the present invention will now be explained in greater detail, particularly with reference to FIG. 4.

Assuming the cabinet structure 16 is initially in the closed position, then the door 36 can be readily manually opened by initially pivoting the door upwardly in a counterclockwise direction about its upper edge, and then horizontally slidably moved rearwardly into a storage position above the top wall 23. This provides full access to the interior of the cabinet structure. A printer of the tractor-feed type is disposed on the upper shelf 31, such printer being indicated in dotted lines at 43 in FIG. 4. A paper supply as indicated at dotted lines at 44 is supported on the middle shelf 32. This paper supply 44 is conventional in that a plurality of sheets are integrally joined together through perforate or score lines so as to form a continuous web, with the sheets being folded on top of one another in a back-and-forth manner. The paper web from the supply 44 is fed upwardly so as to define a paper supply 46 which is fed into the printer, such as around the feed roll thereof. This paper supply 46 is fed upwardly through the slot 34 of the upper shelf 31, which slot 34 encloses and thus controls the movement of the paper and enables it to be fed upwardly behind the printer so as to be properly fed around the drive roll of the printer.

The paper which is discharged from the printer, namely the web indicated at 47, is fed rearwardly and downwardly so as to be positioned behind the supply web 46. This discharge web 47 is also fed downwardly through the slot 34 of the upper shelf 31, and in addition is also fed downwardly through the slot 34 of the middle shelf 32, whereby these slots hence control the vertical downward displacement of the discharged web 47, which downward displacement occurs due to the urging of gravity coupled with the drive of the printer feed roller. This discharged paper web 47 moves downwardly through the slots 34 and collects on the bottom shelf 24. Since the paper collects in the bottom compartment 41, which compartment is open, the printed paper is always readily accessible and thus the operator can readily scan any of the papers as desired, or check to determine if the paper is being properly discharged onto the lower shelf.

Inasmuch as the shelves 31 and 32 both slidably move outwardly of the cabinet, this greatly facilitates access to the slots 34 and hence facilitates the feeding of the webs 46 and 47 through the slots 34, and also the feeding of the paper into and through the printer. After the paper has been properly fed into and through the printer, and through the slots 34, the shelves 31 and 32 are both moved backwardly into the cabinet when utilization of the printer is desired. The door 36 is again returned to its closed position so as to close off the compartments 38 and 39, whereby the noise of the printer is confined so as to significantly improve the quietness of the surrounding environment.

If desired, the middle shelf 32 can be fixedly positioned within the cabinet in a manner similar to the bottom shelf 24 since the shelf 32 can be conveniently used as a paper supply without requiring that it be horizontally slidable outwardly of the cabinet.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a work station for use with a computer having a printer attached thereto, said work station including an upright space-dividing wall panel, a desklike work surface means mounted on said wall panel and projecting horizontally outwardly from one side thereof in cantilevered fashion, said work surface means defining thereon an upper horizontally enlarged upper surface adapted to support a computer, and a cabinet structure attached to said panel adjacent the one side thereof and projecting outwardly therefrom in a cantilevered fashion, said cabinet structure being spaced upwardly above said work surface means, the improvement wherein said cabinet structure comprises:

a rigid cabinet frame formed by substantially parallel sidewalls joined together by substantially parallel top and bottom walls, the bottom wall defining a bottom shelf;

upper and intermediate shelves disposed in vertically spaced relationship to one another and in generally parallel and vertically spaced relationship between said top and bottom walls, said upper shelf being horizontally slidably supported on said cabinet frame for movement between a closed position wherein the upper shelf is disposed within the interior of the frame and an open position wherein the upper shelf projects outwardly beyond a front side of the frame; and door means movably attached to said frame and normally closing off at least a part of the front side of said cabinet structure, said door means being movable between an open position wherein the door means is positioned adjacent the top wall of the frame and a closed position wherein the door means is substantially flush with and extends across the width of the front side of the frame, said door means when in said closed position projecting downwardly through a sufficient vertical extent as to vertically extend between the top wall and the intermediate shelf so as to define closed upper and intermediate compartments which are defined behind the door means and respectively above the upper and intermediate shelves;

each of said upper and intermediate shelves having paper-receiving opening means extending vertically therethrough adjacent the rear edge thereof;

whereby a printer can be supported on said upper shelf, a paper supply supported on the intermediate shelf, a paper web fed upwardly from the supply through the opening means in the upper shelf to the printer, and a paper web discharged from the printer downwardly through the opening means of the upper and intermediate shelves for collection on the bottom shelf.

2. A cabinet structure according to claim 1, wherein said intermediate shelf is also horizontally slidably supported on the frame.

3. A cabinet structure, particularly for a printer, comprising:

a rigid cabinet frame formed by substantially parallel sidewalls joined together by substantially parallel top and bottom walls, the bottom wall defining a bottom shelf;

upper and intermediate shelves disposed in vertically spaced relationship to one another and in generally parallel and vertically spaced relationship between said top and bottom walls, said upper shelf being horizontally slidably supported on said cabinet frame for movement between a closed position wherein the upper shelf is disposed within the interior of the frame and an open position wherein the upper shelf projects outwardly beyond a front side of the frame; and door means movably attached to said frame and normally closing off at least a part of the front side of said cabinet structure, said door means being movable between an open position wherein the door means is positioned adjacent the top wall of the frame and a closed position wherein the door means is substantially flush with and extends across the width of the front side of the frame, said door means when in said closed position projecting downwardly through a sufficient vertical extent as to vertically extend between the top wall and the intermediate shelf so as to define closed upper and intermediate compartments which are defined behind the door means and respectively above the upper and intermediate shelves;

each of said upper and intermediate shelves having paper-receiving opening means extending vertically therethrough adjacent the rear edge thereof;

whereby a printer can be supported on said upper shelf, a paper supply supported on the intermediate shelf, a paper web fed upwardly from the supply through the opening means in the upper shelf to the printer, and a paper web discharged from the printer downwardly through the opening means of the upper and intermediate shelves for collection on the bottom shelf.

4. A cabinet structure according to claim 3, wherein said intermediate shelf is also horizontally slidably supported on the frame.

5. A cabinet structure according to claim 3, wherein said door means has the lower free edge thereof disposed substantially at the elevation of the intermediate shelf so that a lower storage compartment as defined above the bottom shelf is always accessible through the front side of the cabinet frame.

6. A cabinet structure according to claim 5, wherein the door means is attached to the top wall through a conventional hinged telescopic slide means for enabling the door means to be pivoted upwardly and then horizontally slidably moved into a storage position disposed above the top wall when the door means is in its open position.

7. A cabinet structure according to claim 5, wherein the opening means as associated with each of said upper and intermediate shelves comprises a slot which extends vertically through the respective shelf and is elongated in the lengthwise direction of the respective shelf, said slot being spaced inwardly a small distance from the rear edge of the respective shelf so as to provide for horizontal confinement of the paper web as it passes vertically through the slot.

8. A cabinet structure, specifically for housing a printer, comprising:

a cabinet frame defined by substantially parallel side walls rigidly joined together by a top wall, said cabinet frame defining a storage compartment, and wall means associated with said frame for closing off the rear side thereof, the front side of said frame being open so as to provide access into said storage compartment;

door means movably connected to said frame and positionable in a closed position wherein it extends horizontally across the front side of said frame and also extends downwardly from said top wall across a substantial vertical extent of said front side for at least partially closing off the front side of said compartment, said door means being movable relative to said frame into an open position wherein it is positioned adjacent said top wall so as to wholly uncover the front side of said frame;

a first horizontally extending shelf positioned within the frame so as to extend horizontally within the frame, said first shelf being spaced vertically downwardly from said top wall so as to define a first compartment therebetween adapted for receiving a printer therein, said first shelf being horizontally slidably supported relative to said frame so as to be horizontally movable so as to project outwardly through the front side of the frame when the door means is in the open position, said first shelf being disposed wholly within the frame when the door means is in the closed position;

a second shelf extending generally horizontally in parallel but vertically downwardly spaced relationship from said first shelf, said second shelf extending generally between said sidewalls so as to define a second compartment as disposed vertically between said first and second shelves, said second compartment being adapted to store therein a supply of paper for the printer; and first opening means extending vertically between said first and second compartments adjacent the rearward edge of said first shelf for permitting webs of paper to be supplied upwardly to and downwardly from the printer, and second vertically extending opening means associated with said second shelf adjacent the rear edge thereof for permitting the paper web from the printer to be fed vertically downwardly therethrough.

9. A cabinet structure according to claim 8, including means disposed below said second opening means for receiving the paper web from the printer.

10. A cabinet structure according to claim 9, wherein said last-mentioned means includes a third horizontally extending shelf which is parallel to and spaced vertically downwardly from said second shelf.

11. A cabinet structure according to claim 9, wherein said second shelf is also supported for horizontal slidable displacement relative to said frame so that the second shelf can be moved forwardly through the front side of the cabinet frame.

12. A cabinet structure according to claim 9, wherein each of said opening means comprises a horizontally elongated slot which is positioned adjacent but slightly forwardly from the rear edge of the respective shelf and opens vertically downwardly through the respective shelf.

13. In a work station for use with a computer having a printer attached thereto, said work station including an upright space-dividing wall panel, a desklike work surface means mounted on said wall panel and projecting horizontally outwardly from one side thereof in cantilevered fashion, said work surface means defining thereon an upper horizontally enlarged upper surface adapted to support a computer, and a cabinet structure attached to said panel adjacent the one side thereof and projecting outwardly therefrom in a cantilevered fashion, said cabinet structure being spaced upwardly above said work surface means, the improvement wherein said cabinet structure comprises:

a rigid cabinet frame formed by substantially parallel sidewalls joined together by a top wall, said cabinet frame defining a storage compartment, said panel closing off the rear side of said frame, the front side of said frame being open to provide access into said storage compartment;

door means movably connected to said frame and positionable in a closed position wherein it extends horizontally across the front side of said frame and also extends downwardly from said top wall across a substantial vertical extent of said front side for at least partially closing off the front side of said compartment, said door means being movable relative to said frame into an open position wherein it is positioned adjacent said top wall so as to wholly uncover the front side of said frame;

a first horizontally extending shelf positioned within the frame so as to extend horizontally within the frame, said first shelf being spaced vertically downwardly from said top wall so as to define a first compartment therebetween adapted for receiving a printer therein, said first shelf being horizontally slidably supported relative to said frame so as to be horizontally movable so as to project outwardly through the front side of the frame when the door means is in the open position, said first shelf being disposed wholly within the frame when the door means is in the closed position;

a second shelf extending generally horizontally in parallel but vertically downwardly spaced relationship from said first shelf, said second shelf extending generally between said sidewalls so as to define a second compartment as disposed vertically between said first and second shelves, said second compartment being adapted to store therein a supply of paper for the printer; and first opening means extending vertically between said first and second compartments adjacent the rearward edge of said first shelf for permitting webs of paper to be supplied upwardly to and downwardly from the printer, and second vertically extending opening means associated with said second shelf adjacent the rear edge thereof for permitting the paper web from the printer to be fed vertically downwardly therethrough.

* * * * *